United States Patent [19]

Riboldi

[11] 4,389,874

[45] Jun. 28, 1983

[54] BENDING BRAKE

[75] Inventor: Renato Riboldi, Albiate, Italy

[73] Assignee: Officine Mecchaniche Mario Riboldi S.N.C. di Renato, Carlo Riboldi & C., Albiate, Italy

[21] Appl. No.: 245,711

[22] Filed: Mar. 19, 1981

[30] Foreign Application Priority Data

Mar. 21, 1980 [IT] Italy ..... 20828 A/80

[51] Int. Cl.[3] ..... B21D 7/06

[52] U.S. Cl. ..... 72/389; 72/441; 72/453.14

[58] Field of Search ..... 72/453.14, 389, 386, 72/380, 441; 100/258 A, 258 R, 46

[56] References Cited

U.S. PATENT DOCUMENTS

| | | | |
|---|---|---|---|
| 2,343,167 | 2/1944 | Bench | 100/46 |
| 2,753,689 | 7/1956 | Biggert | 100/258 A |
| 2,781,844 | 2/1957 | Pearson | 100/258 A |
| 3,530,749 | 9/1970 | Rohmer | 100/258 A |

FOREIGN PATENT DOCUMENTS

| | | | |
|---|---|---|---|
| 523730 | 2/1956 | Belgium | 72/453.14 |
| 596479 | 4/1960 | Canada | 72/453.14 |

*Primary Examiner*—Gene Crosby
*Attorney, Agent, or Firm*—Karl F. Ross

[57] ABSTRACT

A bending brake with an elongate horizontal blade lowerable onto a V-shaped die has a fixed bed supporting the die and a pair of parallel hydraulic cylinders with pistons carrying the blade, the cylinders being mounted on brackets rising from the bed above the die. The admission of hydraulic fluid to the cylinders is controlled by electrically operated valves responsive to limit switches as well as a pair of mechanical valves, the latter being disposed close to the ends of the die on the fixed bed and being respectively operated by pins mounted on the vertically reciprocable blade in order to stop the descent of the corresponding piston in a predetermined but adjustable bottom position. The return stroke of the blade is not started until both mechanical valves have thus been operated, thereby ensuring that a workpiece of sheet material between the blade and the die is bent about a crease line having the proper orientation.

11 Claims, 6 Drawing Figures

BENDING BRAKE

FIELD OF THE INVENTION

My present invention relates to a hydraulic press, known in the art as a bending brake, in which two mutually complementary elongate tools (referred to hereinafter as a blade and a die) are used for the plastic deformation of a workpiece of sheet metal or other sheet material into a profile of V, U or similar shape.

BACKGROUND OF THE INVENTION

One of the coacting tools of such a press, usually the die, is mounted on a fixed bed while the other one is vertically reciprocable above that bed by means of two hydraulic cylinders whose pistons are rigid with opposite ends of a carrier therefor. The cylinders are mounted above opposite extremities of the stationary tool on support means, generally in the form of a pair of brackets, rising from the machine bed. The admission of hydraulic fluid—referred to hereinafter as oil—into the cylinders for alternately lowering and raising the reciprocable tool carrier is governed by flow-control means which may comprise one or more solenoid valves responsive to the operation of limit switches determining the top and bottom positions of the carrier.

Despite the symmetrical positioning of the cylinders and the simultaneous application of fluid pressure to their pistons, unavoidable manufacturing tolerances frequently give rise to certain level differences between the bottom positions of the two pistons and thus of opposite ends of the tool carried thereby. These level differences will result in nonuniform penetration of the die by the blade over the length of the workpiece and may therefore lead to inadmissible variations in the cross-sectional area of the profile to be produced. Such an irregular shape may also be caused by an unevenness of the undeformed sheet material on account of which one piston, encountering a greater resistance than the other, does not descend as far as its mate.

OBJECT OF THE INVENTION

The object of my present invention, therefore, is to provide such a press with improved flow-control means designed to minimize irregularities due to differences between the motions of the two pistons.

SUMMARY OF THE INVENTION

I realize this object, in accordance with my present invention, by the provision of a pair of position detectors mounted on the machine bed adjacent opposite extremities of the stationary tool together with a pair of actuators in line with these position detectors on the movable tool carrier, each actuator operating the associated position detector to cut off the supply of hydraulic fluid to the corresponding cylinder upon arrival of the piston thereof in a predetermined position of closest approach to the bed.

Pursuant to a more specific feature of my invention, the two position detectors are shut-off valves inserted in respective flow paths leading from the source of oil to the corresponding cylinders, these shut-off valves being normally biased into an open position and being mechanically displaceable by the associated actuators into a closed position.

I further prefer to provide, as part of the flow-control means, a pair of reversing valves in series with the two shut-off valves for initiating a rising motion of both pistons only upon arrival of both shut-off valves in their closed positions. A common control circuit for the two reversing valves may include for this purpose a pair of monitoring switches closely juxtaposed with the two shut-off valves for sensing their position.

BRIEF DESCRIPTION OF THE DRAWING

The above and other features of my present invention will now be described in detail with reference to the accompanying drawing in which.

SPECIFIC DESCRIPTION

Figure 3:
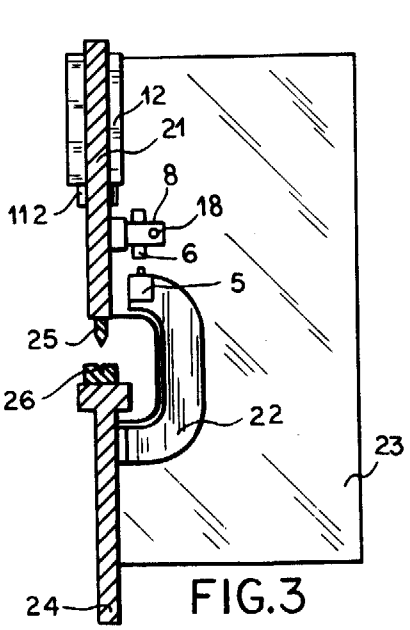
FIGS. 3 and 4 are sectional views respectively taken on lines III—III and IV—IV of FIG. 1.
Figure 2:
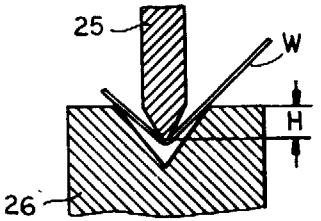
FIG. 2 is a fragmentary cross-sectional view, drawn to a larger scale, of a blade and a die forming part of the bending brake of FIG. 1.
Figure 1:
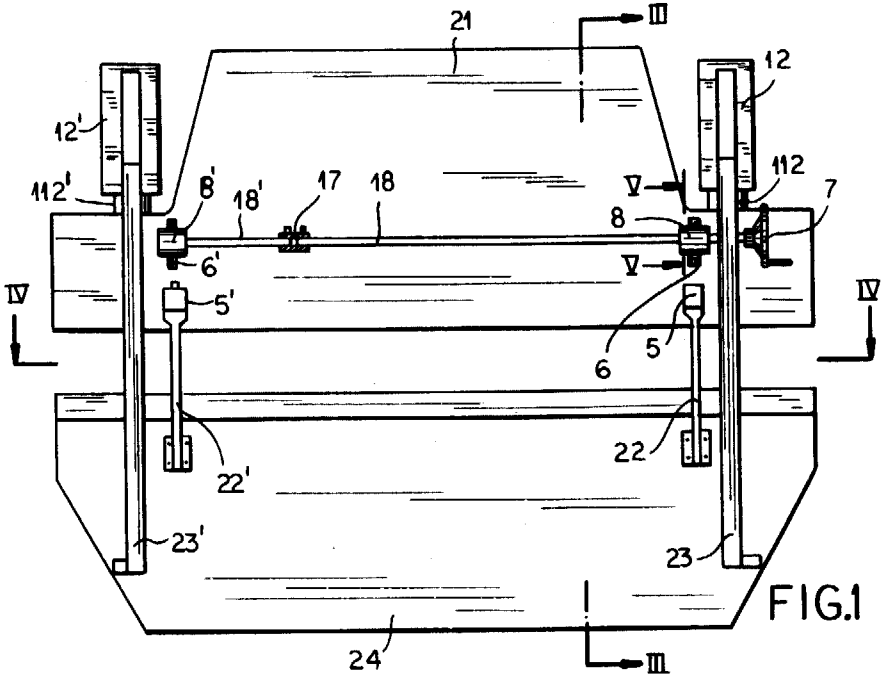
FIG. 1 is a rear-elevational view of a bending brake embodying my invention.
Figure 4:
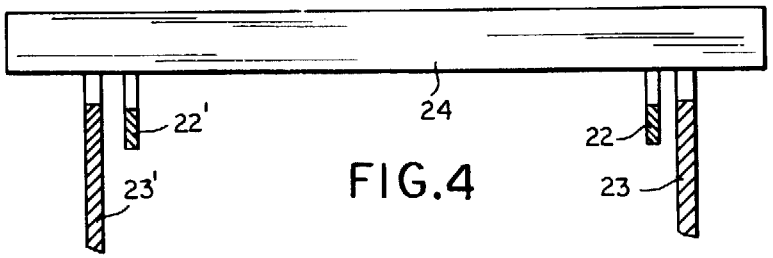

In FIGS. 1 to 3 I have shown a bending brake comprising a fixed bed 24 rigid with two C-shaped brackets 23, 23' which rise above the bed and support two double-acting hydraulic cylinders 12, 12' near opposite extremities of the machine frame. Pistons 112, 112' of cylinders 12, 12' have lower ends rigid with a blade carrier 21 in the form of a massive vertical plate aligned with bed 24.

As illustrated in FIGS. 2 and 3, an elongate horizontal blade 25 secured to carrier 21 overhangs a die 26 of similar length resting on bed 24. Die 26 is here shown formed with a V-groove whose vertex angle corresponds to that of a lower edge of blade 25 designed to penetrate the groove to an extent H for the purpose of deforming a sheet-metal workpiece W. The two tools 25 and 26 may be assumed to extend over practically the full length of bed 24 and carrier 21.

Figure 5:
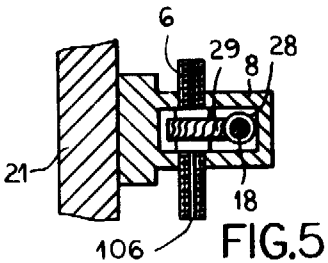
FIG. 5 is an enlarged fragmentary sectional view taken on the line V—V of FIG. 1.
Figure 6:
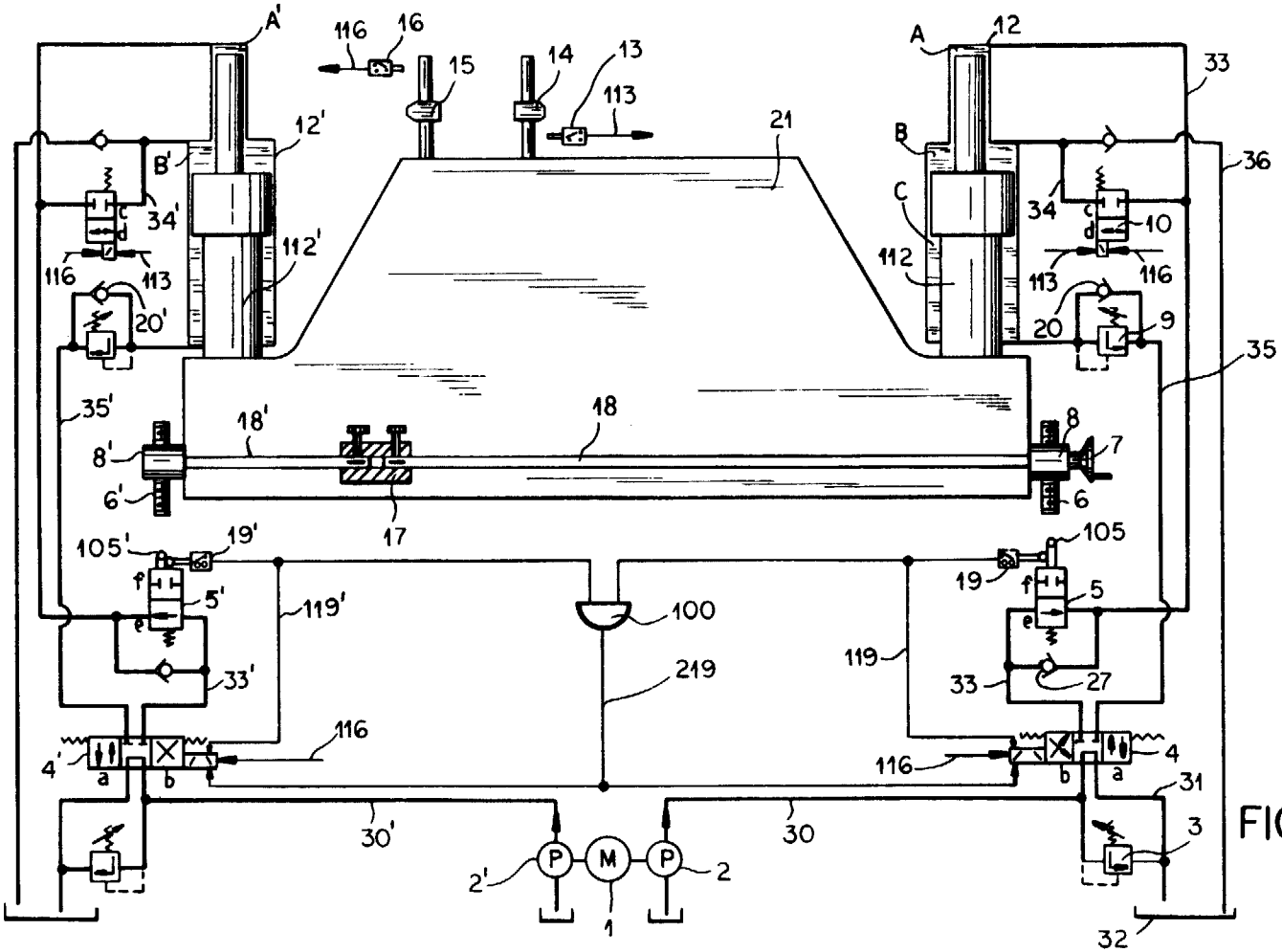
FIG. 6 diagrammatically illustrates part of the bending brake of FIG. 1 together with circuitry controlling the flow of oil into and out of a pair of hydraulic cylinders serving for the vertical reciprocation of its blade.

As shown in FIG. 6, two lugs 14 and 15 are adjustably mounted on carrier 21 to trip a level-sensing switch 13 and a limit switch 16, respectively. Limit switch 16 operates in the well-known manner to halt the ascent of carrier 21 by cutting off the admission of oil to lower ports of cylinders 12 and 12' as more fully described hereinafter. Switch 13 causes a deceleration of the descent of the carrier from an initial approach phase as likewise described in detail below. The bottom position of each piston, however, is individually determined by a pair of position detectors 5, 5' which are mounted on bed 24 with the aid of two yokes 22, 22' closely adjoining the larger brackets 23, 12'. Each position detector 5, 5', designed as a shut-off valve for blocking the flow of oil to an upper port of the respective cylinder 12, 23', lies directly below an actuator 8, 8' which is secured to the rear face of carrier 21 and comprises an upright pin 6, 6' that is vertically adjustable with the aid of a handwheel 7 on a shaft 18. As more fully illustrated in FIG. 5, shaft 18 carries a worm 28 in mesh with a worm wheel 29 which has internal threads engaging external threads of pin 6. The pin has a longitudinal groove 106 engaged by a nonillustrated setscrew so as to be nonrotatably guided in the housing of actuator 8. Rotation of handwheel 7 enables a vernier adjustment of both pins 6 and 6' since the left-hand actuator 8' (as in FIGS. 1 and 6) is penetrated by an extension 18' of shaft 18; a sleeve 17 firmly couples shaft 18 to its extension 18' but can be released to enable a relative rotation thereof for the purpose of changing the relative levels of the lower ends of the two pins. Normally, this adjustment will be such that the valves 5, 5' will be closed by the respective pins 6, 6' when opposite ends of the bending edge of blade 25 lie at exactly the same distance H from the upper surface of die 26; in principle, however, the tools 25, 26 may be so shaped that the desired penetration depth H is different at opposite ends to provide a slanting fold line.

In FIG. 6 I have also shown two monitoring switches 19, 19' which are closely juxtaposed with the respective position-detecting shut-off valves 5, 5' so as to be tripped by stems 105, 105' thereof when these valves are in their closure position. Valves 5 and 5' lie in series with respective reversing valves 4 and 4' of the three-position type controlled by output leads 116 and 119, 119'.

In operation, a motor 1 drives two pumps 2, 2' delivering oil concurrently to the symmetrical halves of the control circuit of FIG. 6 which are respectively associated with the right-hand and left-hand cylinders 12 and 12'; since their operations are identical, only the right-hand half of FIG. 6 will be described in detail. Pump 2 works into a high-pressure conduit 30 which in the illustrated midposition of valve 4 is joined to a low-pressure conduit 31 leading to a sump 32; the two conduits 30 and 21 are also interconnected by a pressure-relief valve 3. A conduit 33 extends from valve 4 by way of valve 5 to the upper inlet port of cylinder 12 and has a branch 34 containing another two-position valve 10 which is controlled by output leads 113, 116 of switches 13 and 16. The bottom port of cylinder 12 is connected to a conduit 35 including a pressure-relief valve 9 shunted by a check valve 20. Another check valve 27 lies in parallel with position-detecting valve 5.

Upon closure of a nonillustrated start switch, and with pistons 112, 112' in their top position, lug 15 closes limit switch 16 whereby valve 10 is held in its illustrated closure position c while valve 4 is moved from its midposition into position a so that conduits 30 and 31 respectively communicate with conduits 33 and 35. As valve 5 is biased into its open position e, oil flows through conduit 33 to the top of cylinder 12 and enters a small-diameter upper compartment A thereof so as to drive the piston 112 rapidly downward. The rate of descent is controlled by the spring-biased valve 9 in the return conduit 35 through which oil displaced from a large-diameter lower compartment C passes to the sump 32. An intermediate compartment B of cylinder 12, of larger effective cross-section than compartments A and C, draws oil at this time from the sump 23 through a conduit 36 by way of a check valve 11. When the lug 14 engages the switch 13 in an intermediate position in which blade 25 almost touches the workpiece W lying flat on die 26, valve 10 is moved into its open position d whereby some of the oil under pressure passes from conduit 33 to compartment B and blocks the check valve 11 so that the descent of piston 112 is slowed.

As the piston 112 approaches the end if its downstroke, pin 6 engages the stem 105 of valve 5 and moves it into its closure position f. This cuts off the oil flow through conduit 33 and, simultaneously, trips the monitoring switch 19 whereby valve 4 is returned to its intermediate position blocking the outflow of oil from compartment C through conduit 35. Piston 112 is thus promptly arrested with blade 25 penetrating to the desired depth H in die 26.

The operation just described for the right-hand cylinder 12 also takes place substantially concurrently at its left-hand counterpart 12'. If, however, the closure of the left-hand valve 5' and the tripping of the associated monitoring switch 19' is delayed, piston 112' will continue its descent until the corresponding end of blade 25 has reached the same depth of penetration. An AND gate 100 conducts only when both switches 19, 19' are tripped, thereby energizing its output lead 219 which causes the two reversing valves 4, 4' to move into their alternate working positions b in which conduits 30, 30' communicate with the lower ports of cylinders 12, 12' by way of conduits 35, 35' and check valves 20, 20' to drive the two pistons 112, 112' rapidly upward; oil displaced from compartments A, A' leaves cylinders 12, 12' through conduits 33, 33' and check valves 27, 27' while the oil in compartments B, B' passes out via branches 34, 34' and valves 10, 10' which remain in their open position d until limit switch 16 is tripped. Since valves 5, 5' have both returned in the interim to their open position e, the cycle can now be repeated.

I claim:

1. In a bending brake comprising a pair of complementary elongate sheet-deforming tools, a fixed bed carrying one of said tools in a substantially horizontal position, a vertically movable carrier for the other of said tools, support means rising from said bed, a pair of hydraulic cylinders symmetrically mounted on said support means above opposite extremities of said carrier, said cylinders being provided with vertically reciprocable pistons rigidly secured to opposite ends of said carrier for holding same substantially horizontally above said one of said tools, a source of hydraulic fluid, and flow-control means for simultaneously directing hydraulic fluid from said source to corresponding ports of said cylinders to reciprocate said pistons and said carrier between a top position and a bottom position with resulting deformation of a workpiece of sheet material inserted between said tools, the improvement wherein said flow-control means comprises a pair of shut-off valves mounted on said bed adjacent said extremities in respective flow paths leading from said source to the corresponding cylinders, a pair of reversing valves in said flow paths jointly controlled by said shut-off valves for initiating a rising motion of both pistons only upon arrival of both shut-off valves in the closed position thereof, and a pair of actuators in line with said shut-off valves on said carrier for operating each shut-off valve to cut off the supply of hydraulic fluid to the corresponding cylinder upon arrival of the respective piston in a predetermined position of closest approach to said bed, said shut-off valves being normally biased into an open position and being mechanically displaceable by said actuators into a closed position.

2. A bending brake as defined in claim 1 wherein said shut-off valves are closely juxtaposed with respective monitoring switches sensing said closed position thereof, said monitoring switches being part of a common control circuit for said reversing valves.

3. A bending brake as defined in claim 2 wherein said actuators are vertical pins mounted in lugs projecting from a face of said carrier.

4. A bending brake as defined in claim 3 wherein said lugs are provided with setting means for selectively raising and lowering said pins.

5. A bending brake as defined in claim 3 wherein said one of said tools is a die with a longitudinal groove, said other of said tools being a blade with a lower edge fitting into said groove.

6. In a bending brake comprising a pair of complementary elongate sheet-deforming tools, a fixed bed carrying one of said tools in a substantially horizontal position, a vertically movable carrier for the other of said tools, support means rising from said bed, a pair of hydraulic cylinders symmetrically mounted on said support means above opposite extremities of said carrier, said cylinders being provided with vertically reciprocable pistons rigidly secured to opposite ends of said carrier for holding same substantially horizontally above said one of said tools, a source of hydraulic fluid, and flow-control means for simultaneously directing hydraulic fluid from said source to corresponding ports of said cylinders to reciprocate said pistons and said carrier between a top position and a bottom position with resulting deformation of a workpiece of sheet material inserted between said tools, the improvement wherein said flow-control means comprises a pair of shut-off valves mounted on said bed adjacent said extremities in respective flow paths leading from said source to the corresponding cylinders, and a pair of vertical pins in line with said shut-off valves on said carrier for operating each shut-off valve to cut off the supply of hydraulic fluid to the corresponding cylinder upon arrival of the respective piston in a predetermined position of closest approach to said bed, said shut-off valves being normally biased into an open position and being mechanically displaceable by said pins into a closed position, said pins being mounted in lugs which project from a face of said carrier and are provided with setting means for selectively raising and lowering said pins.

7. A bending brake as defined in claim 4 wherein said setting means comprises a pair of worms respectively coacting with said pins and a horizontal rod interconnecting said worms, said rod being divided into two sections interlinked by a coupling sleeve enabling relative rotary adjustment.

8. In a bending brake comprising a pair of complementary elongate sheet-deforming tools, one of said tools being a die with a longitudinal groove, the other of said tools being a blade fitting into said groove, a fixed bed carrying one of said tools in a substantially horizontal position, a vertically movable carrier for said blade, support means rising from said bed, a pair of hydraulic cylinders symmetrically mounted on said support means above opposite extremities of said carrier, said cylinders being provided with vertically reciprocable pistons rigidly secured to opposite ends of said carrier for holding same substantially horizontally above said die, a source of hydraulic fluid, and flow-control means for simultaneously directing hydraulic fluid from said source to corresponding ports of said cylinders to reciprocate said pistons and said carrier between a top position and a bottom position with resulting deformation of a workpiece of sheet material inserted between said tools, the improvement wherein said flow-control means comprises a pair of shut-off valves mounted on said bed adjacent said extremities in respective flow paths leading from said source to the corresponding cylinders, and a pair of vertical pins in line with said shut-off valves on said carrier for operating each shut-off valve to cut off the supply of hydraulic fluid to the corresponding cylinder upon arrival of the respective piston in a predetermined position of closest approach to said bed, said shut-off valves being normally biased into an open position and being mechanically displaceable by said pins into a closed position.

9. A bending brake as defined in claim 6 or 8 wherein said flow-control means further comprises a pair of reversing valves in said flow paths jointly controlled by said shut-off valves for initiating a rising motion of both pistons only upon arrival of both shut-off valves in the closed position thereof.

10. A bending brake as defined in claim 1, 6, 8 or 4 wherein said support means comprises a pair of vertical brackets respectively carrying said cylinders.

11. A bending brake as defined in claim 10 wherein said shut-off valves are mounted on yokes rising from said bed alongside said brackets.

* * * * *